US010928117B2

(12) United States Patent
Feng et al.

(10) Patent No.: US 10,928,117 B2
(45) Date of Patent: Feb. 23, 2021

(54) MOTOR AND DRIVE ARRANGEMENT FOR REFRIGERATION SYSTEM

(71) Applicant: Carrier Corporation, Farmington, CT (US)

(72) Inventors: Yinshan Feng, South Windsor, CT (US); Parmesh Verma, South Windsor, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/029,771

(22) PCT Filed: Aug. 14, 2014

(86) PCT No.: PCT/US2014/051030

§ 371 (c)(1),
(2) Date: Apr. 15, 2016

(87) PCT Pub. No.: WO2015/057298

PCT Pub. Date: Apr. 23, 2015

(65) Prior Publication Data

US 2016/0252289 A1 Sep. 1, 2016

Related U.S. Application Data

(60) Provisional application No. 61/892,146, filed on Oct. 17, 2013.

(51) Int. Cl.
*F25D 17/06* (2006.01)
*F25B 25/00* (2006.01)
(Continued)

(52) U.S. Cl.
CPC ..... *F25D 17/067* (2013.01); *F25B 23/006* (2013.01); *F25B 25/005* (2013.01); *F25B 41/00* (2013.01)

(58) Field of Classification Search
CPC ..... H02P 25/00; F28C 1/14; F28D 1/0475; F25B 25/005; F25B 41/00
See application file for complete search history.

(56) References Cited

U.S. PATENT DOCUMENTS 3,165,902 A * 1/1965 Paugh ..... F28D 5/00 62/171
3,384,165 A * 5/1968 Mathews ..... F28B 1/06 165/122
(Continued)

FOREIGN PATENT DOCUMENTS

EP 0716499 A1 * 6/1996 ..... H02P 6/08
EP 2455526 A1 5/2012
(Continued)

OTHER PUBLICATIONS

WO2007/125967A1 machine translation.*
(Continued)

*Primary Examiner* — Gordon A Jones
(74) *Attorney, Agent, or Firm* — Cantor Colburn LLP

(57) ABSTRACT

A heat exchanger system includes a heat exchanger coil circulating a first heat transfer fluid therethrough, and a fan at least partially surrounded by the heat exchanger coil to urge a flow of air through the heat exchanger coil to dissipate thermal energy from the first heat transfer fluid. A brushless direct current fan motor is located the fan to urge rotation of the fan and an ancillary electrical component operably connected to the heat exchanger system and electrically isolated from the first heat transfer fluid.

18 Claims, 1 Drawing Sheet

(51) Int. Cl.
*F25B 41/00* (2021.01)
*F25B 23/00* (2006.01)

(56) References Cited

U.S. PATENT DOCUMENTS

| | | | | |
|---|---|---|---|---|
| 4,332,137 | A * | 6/1982 | Hayes, Jr. | F25B 13/00 62/151 |
| 5,020,320 | A * | 6/1991 | Talbert | F24D 15/04 237/2 B |
| 5,363,746 | A | 11/1994 | Gordon | |
| 5,435,382 | A * | 7/1995 | Carter | F28C 1/14 165/110 |
| 5,625,264 | A * | 4/1997 | Yoon | H02P 6/10 318/400.02 |
| 5,818,131 | A | 10/1998 | Zhang | |
| 5,832,739 | A * | 11/1998 | Bacchus | F25B 39/04 62/310 |
| 5,906,107 | A * | 5/1999 | Takahashi | F24F 1/0007 62/199 |
| 6,213,200 | B1 * | 4/2001 | Carter | F28C 1/14 165/110 |
| 6,433,497 | B1 * | 8/2002 | Lee | H02P 6/182 318/139 |
| 7,082,786 | B2 | 8/2006 | Yasunori et al. | |
| 7,084,598 | B2 | 8/2006 | Yoshida et al. | |
| 7,089,128 | B2 * | 8/2006 | Liu | G06F 1/206 702/64 |
| 7,263,852 | B2 * | 9/2007 | Bacchus | F25B 39/04 62/305 |
| 7,719,216 | B2 | 5/2010 | Sato et al. | |
| 7,726,141 | B2 | 6/2010 | Sim et al. | |
| 7,847,457 | B2 * | 12/2010 | Achor | F02M 37/08 29/596 |
| 8,184,436 | B2 * | 5/2012 | Campbell | H05K 7/20809 165/104.21 |
| 8,393,171 | B2 | 3/2013 | Alston | |
| 8,866,565 | B2 * | 10/2014 | Lai | H01F 17/062 333/172 |
| 2004/0251860 | A1 * | 12/2004 | Ehsani | H02P 6/06 318/400.01 |
| 2005/0103029 | A1 | 5/2005 | Kawahara et al. | |
| 2007/0227168 | A1 | 10/2007 | Simmons | |
| 2008/0156014 | A1 * | 7/2008 | Kopko | F25B 39/04 62/314 |
| 2009/0158760 | A1 | 6/2009 | Sundhar | |
| 2009/0193828 | A1 | 8/2009 | Cocchi et al. | |
| 2010/0011803 | A1 * | 1/2010 | Warnecker | F24F 1/12 62/498 |
| 2010/0052599 | A1 * | 3/2010 | Nagai | H02P 1/426 318/766 |
| 2013/0276476 | A1 * | 10/2013 | Wong | F28F 25/04 62/513 |
| 2014/0260404 | A1 * | 9/2014 | Verma | F25B 9/008 62/333 |

FOREIGN PATENT DOCUMENTS

| | | | | |
|---|---|---|---|---|
| JP | WO 2007125967 | A1 * | 11/2007 | F24F 1/0007 |
| WO | 2007125967 | A1 | 11/2007 | |
| WO | 2013049344 | A2 | 4/2013 | |

OTHER PUBLICATIONS

Praxair Material Safety Data Sheet; Product: Ammonia, Anhydrous P-4562-H Date: Dec. 2009.*

Notification of Transmittal of the International Search Report and the Written Opinion of the International Searching Authority, or the Declaration; Application No. PCT/US2014/051030; dated Nov. 19, 2014; 9 pages.

Ebm-papst ec motors brushless, Accessed Online: Jun. 5, 2019, 5 Pages. URL: https://www.google.com/search?q=ebm-papst+ec+motors+brus . . . .

HVAC Motors, Panasonic Industiral Devices, Accessed Online: May 30, 2019, 2 Pages. URL: https://na.industrial.panasonic.com/products/hvacr-appliance-devices/motors-appliance-hvacr-automotive/lineup/hvac-motors.

* cited by examiner

MOTOR AND DRIVE ARRANGEMENT FOR REFRIGERATION SYSTEM

FEDERAL RESEARCH STATEMENT

This invention was made with government support under contract number DE-EE0003955 awarded by the Department of Energy. The government has certain rights in the invention.

BACKGROUND OF THE INVENTION

The present disclosure relates to refrigeration systems. More specifically, the present disclosure relates to refrigeration systems with multiple heat transfer fluid circulation loops.

Refrigerant systems are known in the HVAC&R (heating, ventilation, air conditioning and refrigeration) art, and operate to compress and circulate a heat transfer fluid throughout a closed-loop heat transfer fluid circuit connecting a plurality of components, to transfer heat away from a secondary fluid to be delivered to a climate-controlled space. In a basic refrigerant system, heat transfer fluid is compressed in a compressor from a lower to a higher pressure and delivered to a downstream heat rejection heat exchanger, commonly referred to as a condenser for applications where the fluid is sub-critical and the heat rejection heat exchanger also serves to condense heat transfer fluid from a gas state to a liquid state. From the heat rejection heat exchanger, where heat is typically transferred from the heat transfer fluid to ambient environment, high-pressure heat transfer fluid flows to an expansion device where it is expanded to a lower pressure and temperature and then is routed to an evaporator, where heat transfer fluid cools a secondary heat transfer fluid to be delivered to the conditioned environment. From the evaporator, heat transfer fluid is returned to the compressor. One common example of refrigerant systems is an air conditioning system, which operates to condition (cool and often dehumidify) air to be delivered into a climate-controlled zone or space. Other examples may include refrigeration systems for various applications requiring refrigerated environments.

Many proposed systems, however, include materials such as propane and $CO_2$ as primary and secondary heat transfer fluids, respectively. Such systems are highly efficient, natural, refrigerant systems, but in the case of propane and similar fluids, flammability is a concern. The U.S. National Electrical Code requires that all electrical devices used with flammable refrigerants must meet explosion proof criteria. As such, condenser fan motors, ad other electrical equipment utilized must meet these requirements. There are, however, few choices for commercially available explosion proof motors, and those that are available are heavy and costly, compared to their non-explosion proof equivalents.

BRIEF DESCRIPTION OF THE INVENTION

In one embodiment, a heat exchanger system includes a heat exchanger coil circulating a first heat transfer fluid therethrough, and a fan at least partially surrounded by the heat exchanger coil to move a flow of air through the heat exchanger coil to dissipate thermal energy from the first heat transfer fluid. A brushless direct current fan motor is located the fan to cause rotation of the fan and an ancillary electrical component is operably connected to the heat exchanger system and electrically isolated from the first heat transfer fluid.

In another embodiment, a heat transfer system includes a first two-phase heat transfer fluid vapor/compression circulation loop including a compressor and a heat exchanger condenser assembly. The condenser assembly includes a heat exchanger coil circulating a first heat transfer fluid therethrough, a fan at least partially surrounded by the heat exchanger coil to urge a flow of air through the heat exchanger coil to dissipate thermal energy from the first heat transfer fluid, a brushless direct current fan motor located at the fan to urge rotation of the fan, and an ancillary electrical component operably connected to the heat exchanger system and electrically isolated from the first heat transfer fluid. The first heat transfer circulation loop further includes an expansion device and a heat absorption side of a heat exchanger evaporator/condenser. A first conduit in a closed fluid circulation loop circulates the first heat transfer fluid therethrough. A second two-phase heat transfer fluid circulation loop transfers heat to the first heat transfer fluid circulation loop through the heat exchanger evaporator/condenser and includes a heat rejection side of the heat exchanger evaporator/condenser, a liquid pump disposed vertically lower than the heat exchanger evaporator/condenser, and a heat exchanger evaporator. A second conduit in a closed fluid circulation loop circulates a second heat transfer fluid therethrough.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
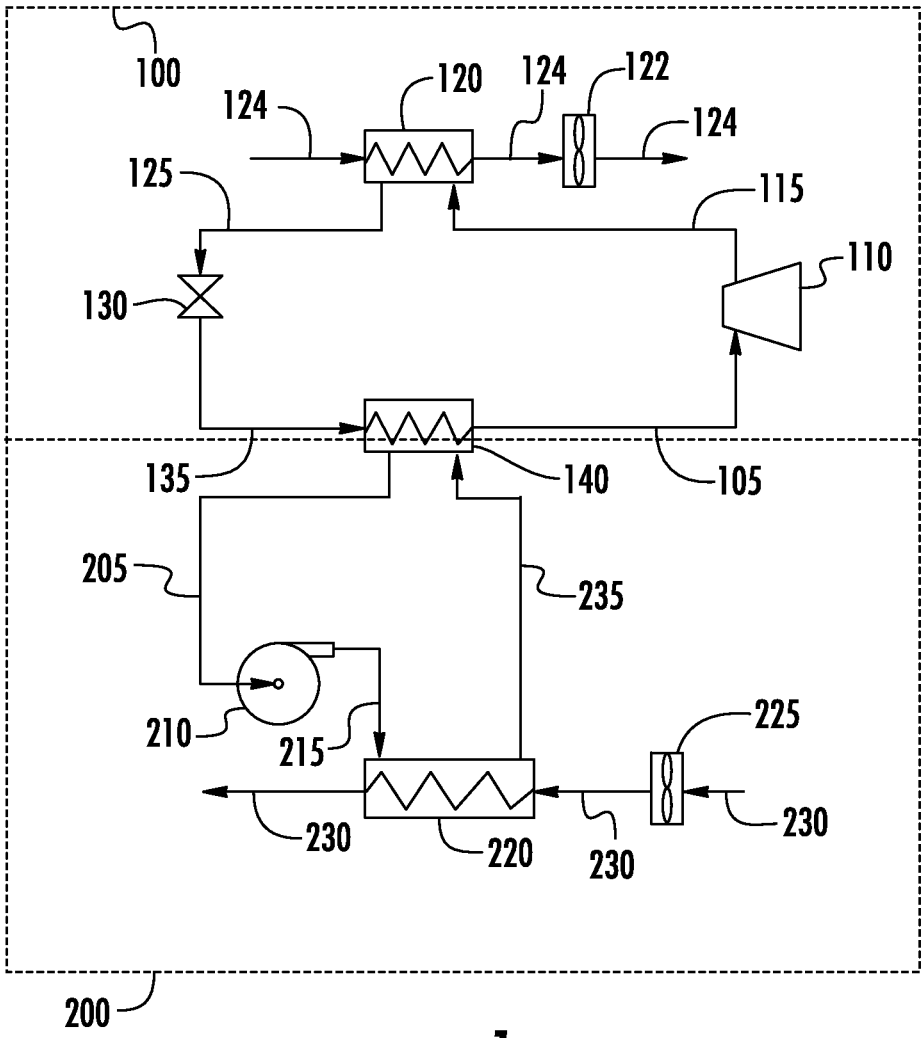
FIG. 1 is a block schematic diagram depicting an embodiment of a heat transfer system having first and second heat transfer fluid circulation loops.

An exemplary heat transfer system with first and second heat transfer fluid circulation loop is shown in block diagram form in FIG. 1. As shown in FIG. 1, a compressor 110 in first fluid circulation loop 100 pressurizes a first heat transfer fluid in its gaseous state, which both heats the fluid and provides pressure to circulate it throughout the system. The hot pressurized gaseous heat transfer fluid exiting from the compressor 110 flows through conduit 115 to heat exchanger condenser 120, which functions as a heat exchanger to transfer heat from the heat transfer fluid to the surrounding environment, such as to air blown by fan 122 through conduit 124 across the heat exchanger condenser 120. The hot heat transfer fluid condenses in the condenser 120 to a pressurized moderate temperature liquid. The liquid heat transfer fluid exiting from the condenser 120 flows through conduit 125 to expansion device 130, where the pressure is reduced. The reduced pressure liquid heat transfer fluid exiting the expansion device 130 flows through conduit 135 to the heat absorption side of heat exchanger evaporator/condenser 140, which functions as a heat exchanger to absorb heat from a second heat transfer fluid in secondary fluid circulation loop 200, and vaporize the first heat transfer fluid to produce heat transfer fluid in its gas state to feed the compressor 110 through conduit 105, thus completing the first fluid circulation loop.

A second heat transfer fluid in second fluid circulation loop 200 transfers heat from the heat rejection side of heat exchanger evaporator/condenser 140 to the first heat transfer fluid on the heat absorption side of the heat exchanger 140, and the second heat transfer fluid vapor is condensed in the process to form second heat transfer fluid in its liquid state. The liquid second heat transfer fluid exits the heat exchanger evaporator/condenser 140 and flows through conduit 205 as a feed stream for liquid pump 210. The liquid second heat transfer fluid exits pump 210 at a higher pressure than the pump inlet pressure and flows through conduit 215 to heat exchanger evaporator 220, where heat is transferred to air blown by fan 225 through conduit 230. Liquid second heat transfer fluid vaporizes in heat exchanger evaporator 220, and gaseous second heat transfer fluid exits the heat exchanger evaporator 220 and flows through conduit 235 to the heat rejection side of heat exchanger evaporator/condenser 140, where it condenses and transfers heat to the first heat transfer fluid in the primary fluid circulation loop 100, thus completing the second fluid circulation loop 200.

In an additional exemplary embodiment, the second fluid circulation loop 200 may include multiple heat exchanger evaporators (and accompanying fans) disposed in parallel in the fluid circulation loop. This may be accomplished by including a header (not shown) in conduit 215 to distribute the second heat transfer fluid output from pump 210 in parallel to a plurality of conduits, each leading to a different heat exchanger evaporator (not shown). The output of each heat exchanger evaporator would feed into another header (not shown), which would feed into conduit 235. Such a system with multiple parallel heat exchanger evaporators can provide heat transfer from a number of locations throughout an indoor environment without requiring a separate outdoor fluid distribution loop for each indoor unit, which cannot be readily achieved using indoor loops based on conventional 2-phase variable refrigerant flow systems that require an expansion device for each evaporator. A similar configuration can optionally be employed in the first fluid circulation loop 100 to include multiple heat exchanger condensers (and accompanying fans and expansion devices) disposed in parallel in the fluid circulation loop, with a header (not shown) in conduit 115 distributing the first heat transfer fluid in parallel to a plurality of conduits each leading to a different heat exchanger condenser and expansion device (not shown), and a header (not shown) in conduit 135 to recombine the parallel fluid flow paths. When multiple heat exchanger condensers are used, the number of heat exchanger condensers and expansion devices would generally be fewer than the number of heat exchanger evaporators.

The first heat transfer fluid circulation loop utilizes heat transfer fluids that are not restricted in terms of flammability and/or toxicity, and this loop is a substantially outdoor loop. The second heat transfer fluid circulation loop utilizes heat transfer fluids that meet certain flammability and toxicity requirements, and this loop is substantially an indoor loop. By substantially outdoor, it is understood that a majority if not all of the loop is outdoors, but that portions of the substantially outdoor first loop may be indoors and that portions of the substantially indoor second loop may be outdoors. In an exemplary embodiment, any indoor portion of the outdoor loop is isolated in a sealed fashion from other protected portions of the indoors so that any leak of the first heat transfer fluid will not escape to protected portions of the indoor structure. In another exemplary embodiment, all of the substantially outdoor loop and components thereof is located outdoors. By at least partially indoor, it is understood that at least a portion of the loop and components thereof is indoors, although some components such as the liquid pump 210 and/or the heat exchanger evaporator condenser 140 may be located outdoors. The at least partially indoor loop can be used to transfer heat from an indoor location that is remote from exterior walls of a building and has more stringent requirements for flammability and toxicity of the heat transfer fluid. The substantially outdoor loop can be used to transfer heat from the indoor loop to the outside environment, and can utilize a heat transfer fluid chosen to provide the outdoor loop with thermodynamic that work efficiently while meeting targets for global warming potential and ozone depleting potential. The placement of portions of the substantially outdoor loop indoors, or portions of the indoor loop outdoors will depend in part on the placement and configuration of the heat exchanger evaporator/condenser, where the two loops come into thermal contact. In an exemplary embodiment where the heat exchanger evaporator/condenser is outdoors, then portions of conduits 205 and/or 235 of the second loop will extend through an exterior building wall to connect with the outdoor heat exchanger evaporator/condenser 140. In an exemplary embodiment where the heat exchanger evaporator/condenser 140 is indoors, then portions of conduits 105 and/or 135 of the first substantially outdoor loop will extend through an exterior building wall to connect with the indoor heat exchanger evaporator/condenser 140. In such an embodiment where portions of the first loop extend indoors, then an enclosure vented to the outside may be provided for the heat exchanger evaporator/condenser 140 and the indoor-extending portions of conduits 105 and/or 135. In another exemplary embodiment, the heat exchanger evaporator/condenser 140 may be integrated with an exterior wall so that neither of the fluid circulation loops will cross outside of their primary (indoor or outdoor) areas.

The heat transfer fluid used in the first fluid circulation loop has a critical temperature of greater than or equal to 31.2° C., more specifically greater than or equal to 35° C., which helps enable it to maintain two phases under normal operating conditions. Exemplary heat transfer fluids for use in the first fluid circulation loop include but are not limited to saturated hydrocarbons (e.g., propane, isobutane), unsaturated hydrocarbons (e.g., propene), R32, R152a, ammonia, an R1234 isomer (e.g., R1234yf, R1234ze, R1234zf), R410a, and mixtures comprising one or more of the foregoing.

The heat transfer fluid used in the second fluid circulation loop has an ASHRAE Class A toxicity rating and an ASHRAE Class 1 or 2L flammability rating. Exemplary heat transfer fluids for use in the second fluid circulation loop include but are not limited to sub-critical fluid $CO_2$, a mixture comprising an R1234 isomer (e.g., R1234yf, R1234ze) and an R134 isomer (e.g., R134a, R134) or R32, 2-phase water, or mixtures comprising one or more of the foregoing. In another exemplary embodiment, the second heat transfer fluid comprises at least 25 wt %, and more specifically at least 50 wt % sub-critical fluid $CO_2$.

Figure 2:
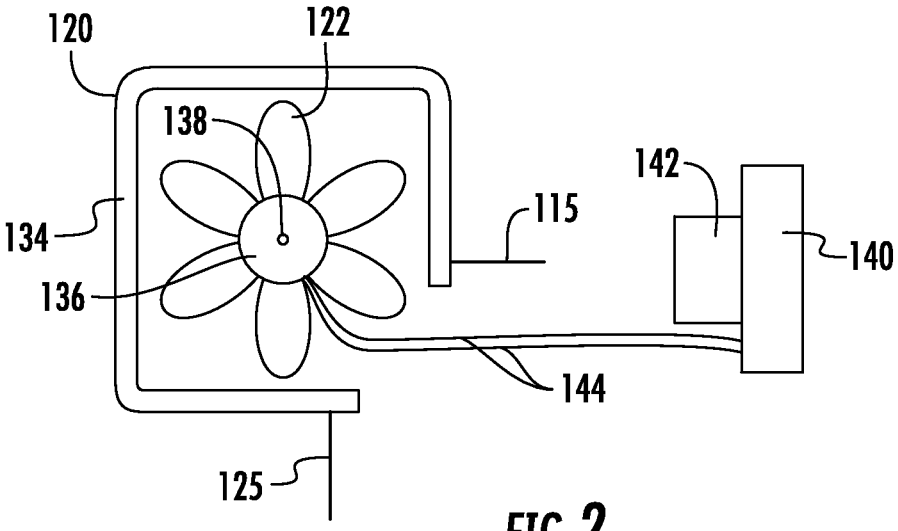
FIG. 2 is a schematic of an embodiment of a heat exchanger fan arrangement for a heat transfer system.

Referring now to FIG. 2, the heat exchanger condenser 120 and fan 122 are illustrated. The heat exchanger condenser 120 includes a condenser coil 134 through which the first heat transfer fluid is circulated. In some embodiments, the condenser coil 134 forms a C-shaped cross-section, at least partially enclosing the fan 122 inside of the cross-section. The fan 122 is driven by a fan motor 136 also located within the cross-section to drive the fan 122 about a fan axis 138. To prevent potential explosion and/or fire due to the flammable nature of the first heat transfer fluid, the fan motor 136 is an arc-free brushless DC motor. The fan motor 136 is connected to and driven by ancillary drive components such as fan motor drive 140 and fan motor controller 142. While the placement of the fan motor drive 140 and fan motor controller 142 are discussed herein, one skilled in the art will appreciate that the embodiments disclosed may be similarly applied to other electrical components such as controllers for the compressor 110 and/or expansion device 130. Rather than being located within the cross-section of the condenser coil 134, as with a typical system, the motor drive 140 and fan motor controller 142 are located remotely, outside of the cross-section of the condenser coil 134 and at a distance from the condenser coil 134 to electrically isolate the drive 140 and controller 142 from the first heat transfer fluid. The motor drive 140 and fan motor controller 142 are located remotely to keep sources of ignition, such as arc or spark, away from the first heat transfer fluid. It is to be appreciated that, in other embodiments, the drive 140 and controller 142 are located inside of the cross-section of the condenser coil 134, but electrically isolated from the first heat transfer fluid via other means, such as an isolation box. The ancillary components are connected to the fan motor 136 via one or more leads 144 that meet leads meeting explosion proof criteria, for example, Class I of the U.S. National Electrical Code. Using a brushless DC fan motor 136 while locating ancillary components such as the fan motor drive 140 and fan motor controller 142 remotely from the condenser coil 134 allows for meeting explosion-proof criteria of systems utilizing flammable refrigerants such as propane. Further, the brushless DC fan motor 136 is a smaller, lighter weight package and is considerably less costly than a traditional explosion-proof AC induction EX motor, typically used in such environments.

The expansion device used in the first heat transfer fluid circulation loop may be any sort of known thermal expansion device, including a simple orifice or a thermal expansion valve (TXV) or an electronically controllable expansion valve (EXV). Expansion valves can be controlled to control superheating at the outlet of the heat absorption side of the heat exchanger evaporator/condenser and optimize system performance. Such devices and their operation are well-known in the art and do not require additional detailed explanation herein.

In another exemplary embodiment, one or more of the compressor 110, fan 122, fan 225, and/or pump 210 utilizes a variable speed drive (VSD). Control of VSD's can be implemented utilizing known power control technologies, such as an integrated power electronic system incorporating an input power factor correction (PFC) rectifier and one or more inverters (e.g., an inverter for each separate VSD). The input PFC rectifier converts single-phase AC input voltage into a regulated DC common bus voltage in order to provide a near unity power factor with low harmonic current from the AC supply. The motor inverters can be connected in parallel with input drawn from the common DC bus. Motors with higher power requirements (e.g., >1 kW such as for compressors) can use insulated gate bipolar transistors (IGBT's) as power switches whereas motors with lower power requirements (e.g., <1 kW such as for fan blowers) can use lower-cost metal oxide semiconductor field effect transistors (MOSFET's). Any type of electric motor can be used in the VSD's, including induction motors or permanent magnet (PM) motors. In an exemplary embodiment, the compressor 110 utilizes a PM motor, optionally in conjunction with electronic circuitry and/or a microprocessor that adaptively estimates the rotor magnet position using only the winding current signals, thus eliminating the need for expensive Hall effect sensors typically used in PM motors. The precise speed settings of the VSD's will vary depending on the demands placed on the system, but can be set by system control algorithms to maximize system operating efficiency and/or meet system demand as is known in the art. Typically, compressor and pump speed can be varied to control system capacity based on user demand, while the speed of the indoor and outdoor fan blowers can be controlled to optimize system efficiency.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heat exchanger system comprising:

a heat exchanger coil circulating a heat transfer fluid therethrough, the heat exchanger coil having a C-shaped cross-section defining an at least partially enclosed volume inside of the C-shaped cross-section;

a fan disposed inside the C-shaped cross-section of the heat exchanger coil to cause a flow of air through the heat exchanger coil to exchange thermal energy from the heat transfer fluid to the flow of air, such that the C-shaped cross-section is defined in a plane perpendicular to an axis of rotation of the fan, the fan disposed inside of the C-shaped cross-section in said plane;

a brushless direct current fan motor disposed at the fan to urge rotation of the fan; and a fan motor drive and a fan controller both disposed outside of the C-shaped cross-section of the heat exchanger coil, the fan motor drive and the fan controller electrically connected to the fan motor via one or more leads, thereby electrically isolating the fan motor drive and the fan controller from the heat transfer fluid.

2. The heat exchanger system of claim 1, wherein the fan motor drive and the fan controller are located remotely from the heat exchanger coil.

3. The heat exchanger system of claim 1, wherein the fan motor drive and the fan controller are not at least partially surrounded by the heat exchanger coil.

4. The heat exchanger system of claim 1, wherein the heat transfer fluid comprises a mildly flammable or moderately flammable or highly flammable fluid.

5. The heat exchanger system of claim 1, wherein the heat transfer fluid comprises propane, propene, isobutane, R32, R152a, ammonia, an R1234 isomer, or R410A, or a mixture of any of the above.

6. The heat exchanger system of claim 1, wherein the heat exchanger coil is a condenser coil for an air conditioning system.

7. The heat exchanger system of claim 1, wherein the heat exchanger coil is an evaporator coil for an air conditioning system.

8. A heat transfer system comprising:

a first two-phase heat transfer fluid vapor/compression circulation loop including:

a compressor;

a heat exchanger assembly including:

a heat exchanger coil circulating a first heat transfer fluid therethrough, the heat exchanger coil having a C-shaped cross-section defining an at least partially enclosed volume inside of the C-shaped cross-section;

a fan disposed inside the C-shaped cross-section of the heat exchanger coil to cause a flow of air through the heat exchanger coil to exchange thermal energy from the first heat transfer fluid to the flow of air, such that the C-shaped cross-section is defined in a plane perpendicular to an axis of rotation of the fan, the fan disposed inside of the C-shaped cross-section in said plane;

a brushless direct current fan motor disposed at the fan to urge rotation of the fan; and a fan motor drive and a fan controller both disposed outside of the C-shaped cross-section of the heat exchanger coil, the fan motor drive and the fan controller electrically connected to the fan motor via one or more leads, thereby electrically isolating the fan motor drive and the fan controller from the first heat transfer fluid;

an expansion device; and an internal heat exchanger evaporator/condenser;

wherein a first conduit in a closed fluid circulation loop circulates the first heat transfer fluid therethrough; and a second two-phase heat transfer fluid circulation loop that exchanges heat to the first heat transfer fluid circulation loop through the internal heat exchanger evaporator/condenser, including:

a liquid pump disposed vertically lower than the internal heat exchanger evaporator/condenser; and a heat absorption heat exchanger;

wherein a second conduit in a closed fluid circulation loop circulates a second heat transfer fluid therethrough.

9. The heat transfer system of claim 8, wherein the fan motor drive the fan controller are located remotely from the heat exchanger coil.

10. The heat transfer system of claim 8, wherein the fan motor drive and the fan controller are not at least partially surrounded by the heat exchanger coil.

11. The heat transfer system of claim 8, wherein the first heat transfer fluid comprises a mildly flammable or moderately flammable or highly flammable fluid.

12. The heat transfer system of claim 8, wherein the first heat transfer fluid comprises propane, propene, isobutane, R32, R152a, ammonia, an R1234 isomer, or R410A, or a mixture of any of the above.

13. The heat transfer system of claim 8, wherein the heat exchanger coil is a condenser coil for an air conditioning system.

14. The heat transfer system of claim 8, wherein the heat exchanger coil is an evaporator coil for an air conditioning system.

15. The heat transfer system of claim 8, wherein the first fluid circulation loop is disposed at least partially outdoors.

16. The heat transfer system of claim 8, wherein the second fluid circulation loop is disposed at least partially indoors.

17. The heat transfer system of claim 8, wherein the second heat transfer fluid has an ASHRAE Class A toxicity rating and an ASHRAE Class 1 or 2L flammability rating.

18. The heat transfer system of claim 8, wherein the second heat transfer fluid comprises sub-critical fluid $CO_2$.

* * * * *